United States Patent [19]

De Luca et al.

[11] 4,410,773

[45] Oct. 18, 1983

[54] MULTIPOLE DATA SWITCH

[75] Inventors: Paul V. De Luca, Plandome Manor; David Rawlings, Bayville, both of N.Y.

[73] Assignee: Porsa Systems Corp., Syosset, N.Y.

[21] Appl. No.: 310,124

[22] Filed: Oct. 9, 1981

[51] Int. Cl.[3] ..... H01H 19/54

[52] U.S. Cl. ..... 200/11 K; 200/11 G; 200/252; 200/260; 200/274

[58] Field of Search ..... 200/8 R, 8 A, 11 R, 200/11 A, 11 C, 11 D, 11 DA, 11 E, 11 EA, 11 G, 11 J, 11 K, 11 TW, 155 R, 155 A, 239–247, 252, 253, 258, 260, 271–274, 283, 284, 6 A

[56] References Cited

U.S. PATENT DOCUMENTS

| | | | |
|---|---|---|---|
| 2,115,069 | 4/1938 | Hall | 200/11 K |
| 2,127,608 | 8/1938 | Manley | 200/11 J |
| 2,256,181 | 9/1941 | Tyrner | 200/11 J |
| 2,629,787 | 2/1953 | Coles, Jr. et al. | 200/11 K |
| 3,045,075 | 7/1962 | Van Dyke | 200/11 G X |
| 3,098,130 | 6/1963 | Clavel | 200/11 A |
| 3,226,496 | 12/1965 | Seabury, Jr. | 200/11 K |
| 3,260,804 | 7/1966 | Buzzi | 200/11 K |
| 3,368,041 | 2/1968 | Chambaut | 200/11 A |
| 3,383,478 | 5/1968 | Mandel | 200/11 R X |
| 3,538,269 | 11/1970 | Long | 200/11 J |
| 3,715,527 | 2/1973 | Trevisiol | 200/11 K |
| 3,772,485 | 11/1973 | Workings | 200/11 TW |
| 3,856,999 | 12/1974 | Terry et al. | 200/11 K |
| 4,052,573 | 10/1977 | Kojima | 200/11 DA |
| 4,163,879 | 8/1979 | Mayer et al. | 200/11 TW |
| 4,171,470 | 10/1979 | Gettig | 200/6 A |
| 4,267,412 | 5/1981 | Janssen et al. | 200/11 G X |
| 4,348,556 | 9/1982 | Gettig et al. | 200/6 A X |

*Primary Examiner*—J. R. Scott

*Attorney, Agent, or Firm*—Charles E. Temko

[57] ABSTRACT

A rotary type switch for switching a relatively large plurality of independent circuits from one set of contact to a second set of contacts for manual or remote operation using a solenoid or linear actuator. The switch utilizes as contacts a simple wire form cantilevered for compliance at one end, and free to move vertically at an opposite end. A plurality of bridging contacts, properly sized and plated shorts adjacent pairs of wires together when the contacts move in an arcuate path or motion, causing the wires in the path to deflect, and causing the contacts to bridge pairs of adjacent wires to complete a circuit between them. Insulative members are positioned adjacent the gaps between the bridging contacts to limit the degree of flexing of the wires during movement of the bridging contacts.

4 Claims, 7 Drawing Figures

FIG. 3
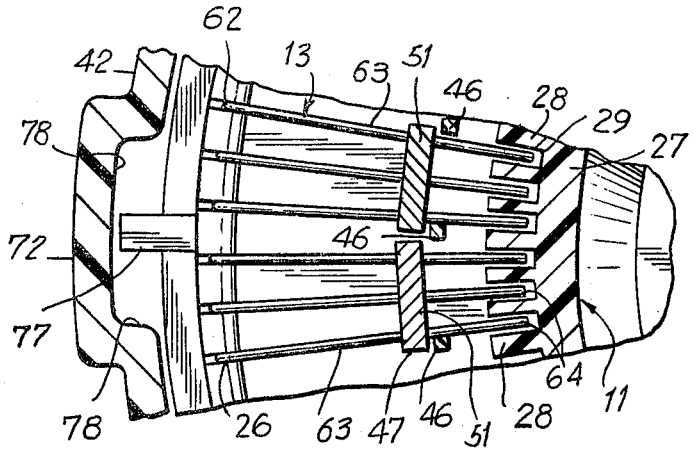
FIG. 5
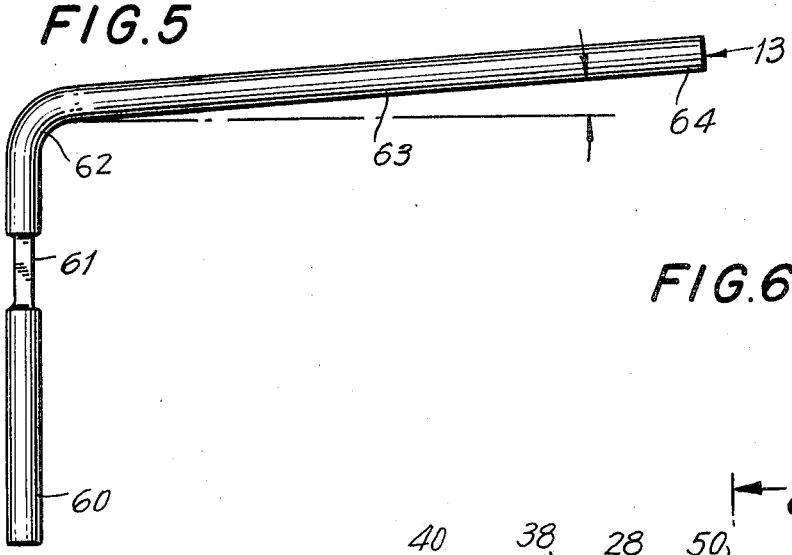
FIG. 6
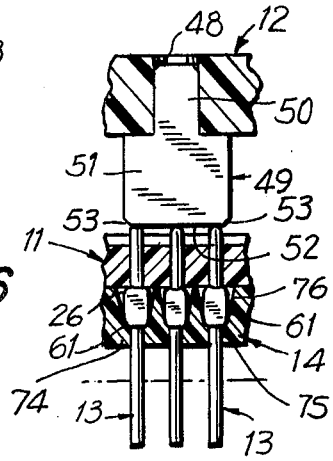
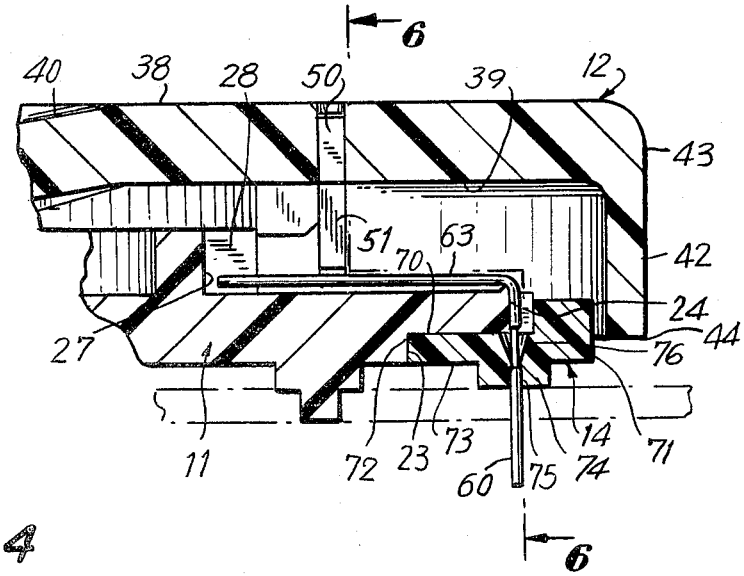
FIG. 4

MULTIPOLE DATA SWITCH

BACKGROUND OF THE INVENTION

This invention relates generally to the field of rotary electric switches with bridging contacts commonly used to selectively connect a large number of independent circuits by moving one set of contacts relative to another. More particularly, it relates to a switch of the type in which the construction thereof has been substantially simplified to result in ease of manufacture, improved reliability, and relatively low production cost. Devices of this general type are well known in the art, and the invention lies in specific constructional details shown in the disclosed embodiment.

In prior art constructions, it is common to provide a relatively fixed stator mounting a plurality of sets of contacts, and a rotor having resiliently urged pins which selectively bridge the contacts on the stator to establish electrical connections therebetween. Adequate contact depends upon the presence of compression of spring-pressed pins, the tension of which weakens with use, as does the ability of the rotor contacts to wipe the surface of the contacts on the stator to remove accumulated oxides thereon.

In most constructions, a mechanical detent means must be provided to selectively fix the adjustment of the stator relative to the rotor. The detenting structure also wears with use, and the snap action of the rotor deteriorates as a result.

SUMMARY OF THE INVENTION

Briefly stated, the invention contemplates the provision of an improved rotary data switch of the class described, in which the contacts on the stator are formed from short lengths of wire in which first portions thereof pass through the body of the stator to provide a conductive terminal, and second portions thereof are bent through substantially a right angle to lie in the path of bridging contacts extending from a surface of the rotor. As the rotor is moved, the bridging contacts deflect the second portions of the wires to provide a wiping effect tending to remove accumulated oxides and other insulative substances, and depress the second portions to place the same under compression. A plurality of individual fins or septums are positioned between adjacent second portions of the wire to prevent any rotational movement thereof about an axis passing through the first portions thereof, the septums forming vertically oriented pockets within which the second portions of the wires may deflect. The stator is provided with resilient sockets into which the wires are laterally inserted during assembly, and axial movement of the wires within the sockets is limited by a flattened area on the wires immediately adjacent the resilient socket.

BRIEF DESCRIPTION OF THE DRAWINGS

In the drawings, to which reference will be made in the specification, similar reference characters have been employed to designate corresponding parts throughout the several views.

FIG. 3 is a fragmentary horizontal sectional view as seen from the plane 3—3 in FIG. 2.

FIG. 4 is an enlarged fragmentary vertical sectional view corresponding to the right hand portion of FIG. 2.

FIG. 5 is an enlarged view in elevation showing an individual contact wire forming a part of the disclosed embodiment.

FIG. 6 is an enlarged view in elevation showing an individual bridging contact forming a part of the disclosed embodiment.

DETAILED DESCRIPTION OF THE DISCLOSED EMBODIMENT

Figure 1:
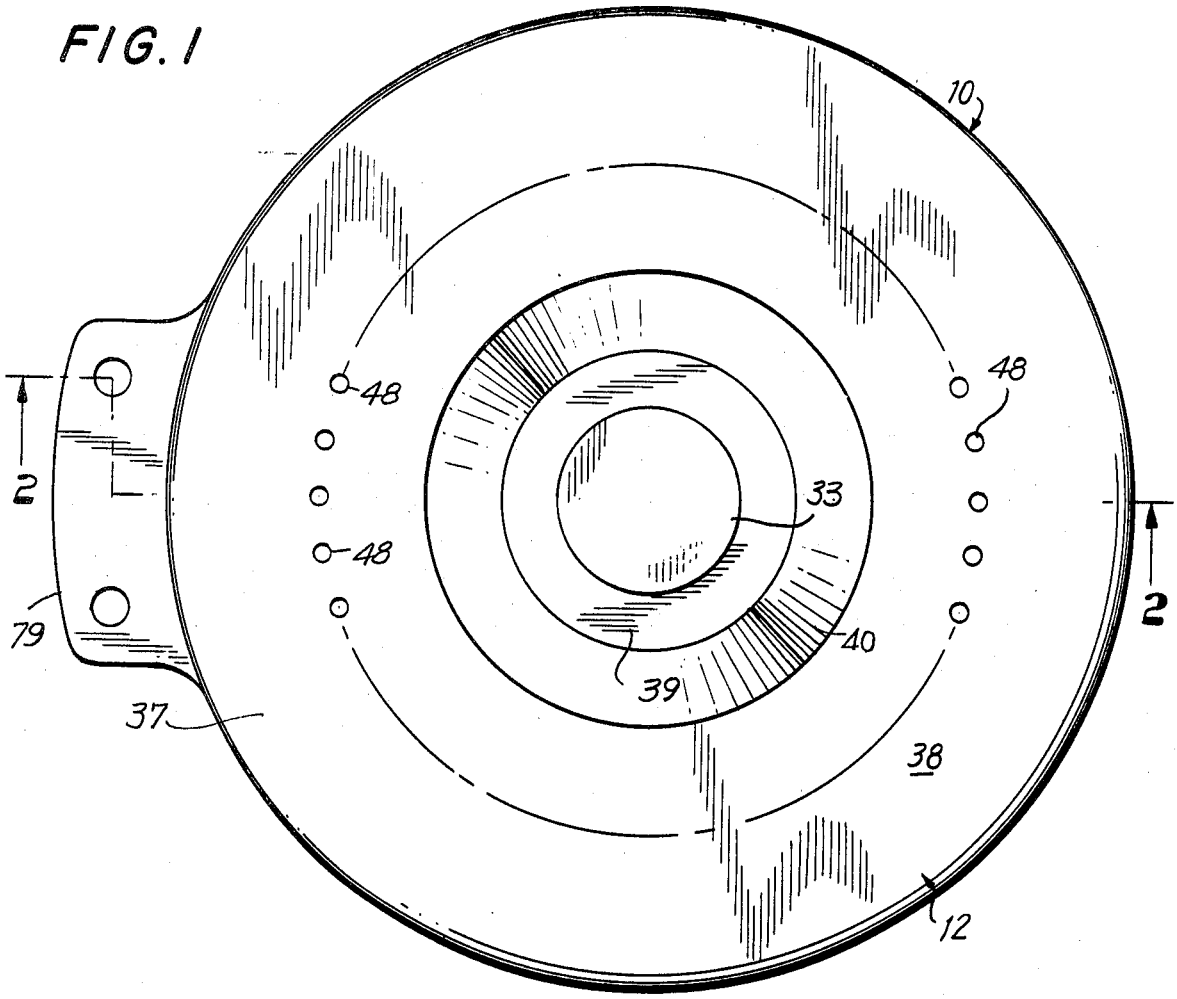
FIG. 1 is a top plan view of an embodiment of the invention.
Figure 2:
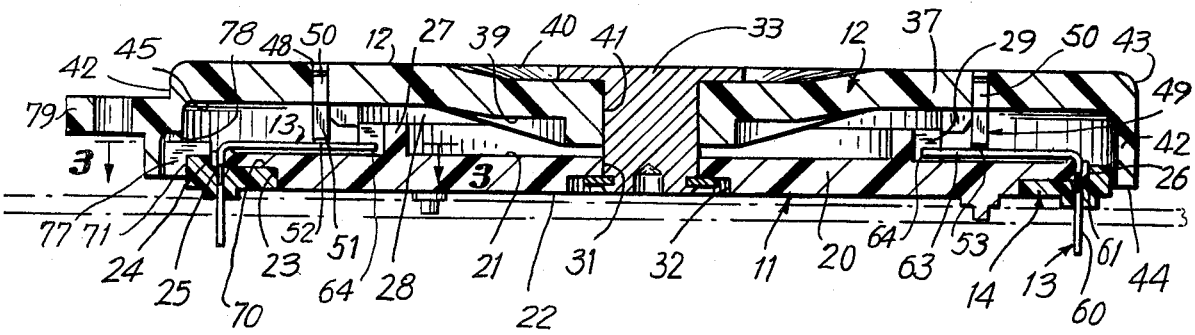
FIG. 2 is a fragmentary vertical sectional view thereof as seen from the plane 2—2 in FIG. 1.
Figure 7:
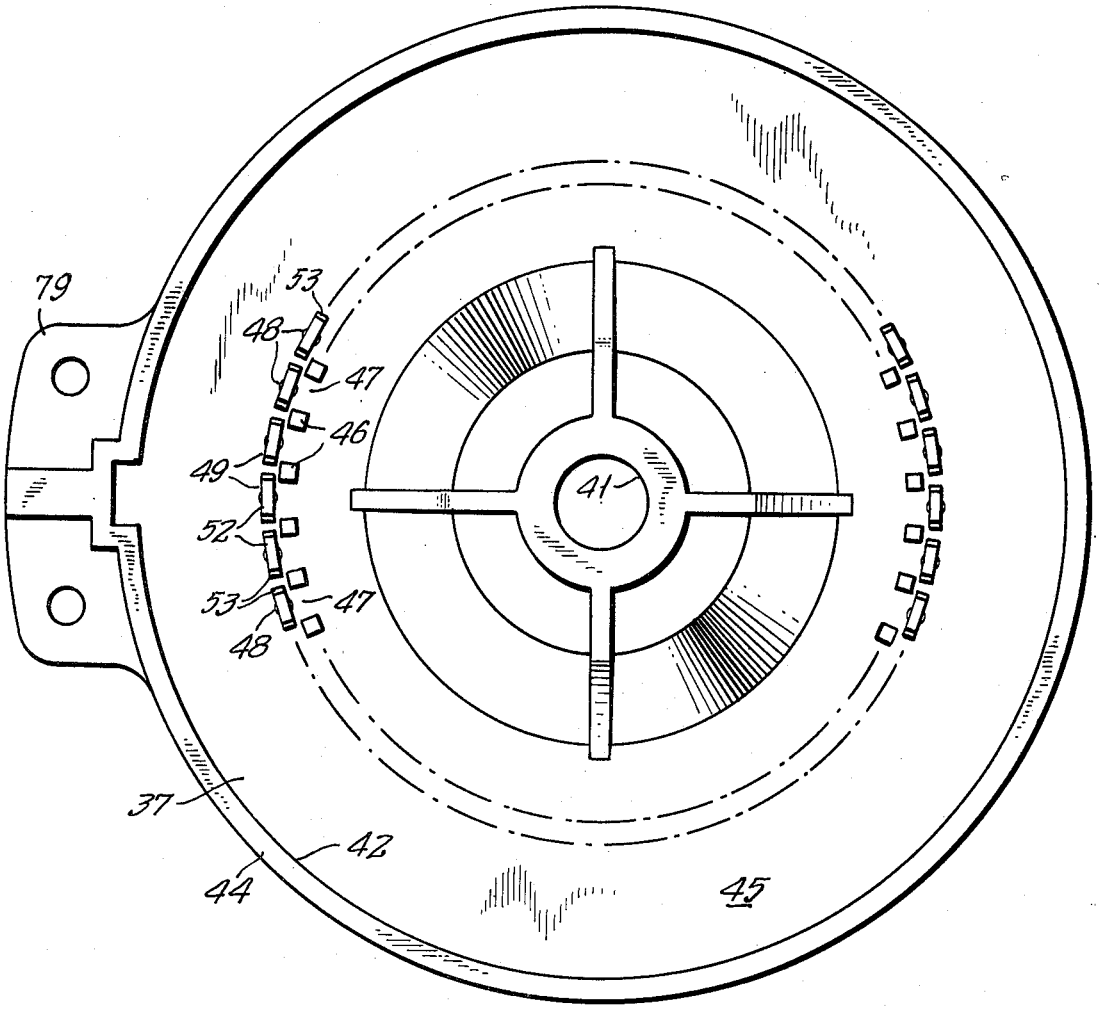
FIG. 7 is a view in elevation showing an inner surface of a rotor element forming a part of the disclosed embodiment.

In accordance with the invention, the device, generally indicated by reference character 10, comprises broadly: a stator element 11, a rotor element 12, a plurality of contact wires 13, and a contact retaining ring 14.

The stator element 11 is preferably of molded synthetic resinous construction, and includes a main body 20 bounded by an upper surface 21 and a lower surface 22 defining rabbet into which the contact retaining ring 14 is positioned. An outer peripheral surface 24 is provided with a plurality of radially arranged slots 25 each leading to a resilient quasi-cylindrical socket 26, each of which accommodates a contact wire 13 which is snapped into position during assembly. An annular wall 27 extends upwardly from the upper surface 21, from which a plurality of radially extending septums 28 extend to form slots 29, each of which is radially aligned with a socket 26. A centrally disposed bore 31 communicates with a counterbore 32 through which interconnecting means 33 passes to align the rotor element 12 for relative movement therewith.

The rotor element 12 is also preferably formed as a synthetic resinous molding, and includes a main body 37 bounded by an outer upper surface 38, an inner upper surface 39 and a interconnecting conical surface 40. A cylindrically disposed bore 41 aligns with the bore 31. A peripheral wall 42 extends downwardly from an upper edge 43 to a free lower edge 44. A lower surface 45 of the body 37 is provided with a plurality of downwardly extending insulative wire tensioning members 46. Located in the area of the interstices 47 therebetween are circular openings 48 each of which accommodates a bridging contact 49 (see FIG. 6). The contacts 49 are preferably formed as stampings from beryllium copper or the like, each including a shank portion 50 which is wedged into an opening 48 and a generally rectangular bridging portion 51 having a transversely extending edge 52 and angularly disposed cam surfaces 53 at each end thereof.

The contact wires 13 are substantially similar, each including a mounting portion 60 having a flattened area 61 thereon leading to a bent portion 62 and a contact portion 63 disposed generally at a right angle with respect to the mounting portion 60. A short segment immediately above the flattened portion 61 is snapped into a socket 26 during assembly, and upward movement is limited by contact of flattened portion 61 with the lower end of the socket 26. The free ends 64 of the contact portions 63 are thereby positioned within the slots 29 which prevents rotation of the contact wire within the respective socket 26.

The contact retaining ring 14, as has been mentioned, is fitted within the rabbet 23 of the stator element 11, and is bounded by an upper surface 70, an outer surface 71, an inner surface 72 and a lower surface 73. A downwardly extending flange 74 is provided with through bores 75, the upper ends 76 of which are flared to facilitate insertion of the contact wires. An upwardly extending projection 77 cooperates with a corresponding recess 78 in the peripheral wall 42 of the rotor element 12 to limit relative movement between the stator and rotor elements to that necessary to open and close individual circuits. A connecting link 79 is provided on the rotor element to permit attachment of manually operated means, or an electrically operated solenoid or linear actuator (not shown).

It will be apparent that in any given adjustment position, a single contact wire on the stator element projects into an interstice between adjacent bridging contacts on the rotor element, wherein the insulative members 46 will provide sufficient tension thereupon to maintain them within the slots 29. Upon relative movement between the rotor and stator elements, the cam surfaces 53 will contact such wire contact and depress it to a point where the bridging contact can ride thereover.

It may thus be seen that we have invented novel and highly useful improvements in multipole data switch construction, in which, in lieu of relatively expensive brass stampings employed to form fixed contacts, the contacts on the stator element are merely short lengths of conductive wire which may be bent to a configuration in which they provide both resiliency and conductivity. Both stator and rotor elements may be formed as simple moldings at very low manufacturing cost.

We wish it to be understood that we do not consider the invention limited to the precise details of structure shown and set forth in this specification, for obvious modifications will occur to those skilled in the art to which the invention pertains.

We claim:

1. A rotary type multipole switch comprising: a stator element and a rotor element arranged in parallel planes for relative incremental movement; said stator element including a contact-supporting area defining a plurality of parallel bores, a plurality of elongated wire-like flexible contacts each having first and second generally rectilinear portions interconnected by a bent portion, said first portions of said contacts being disposed within said bores, said second portions overlying a surface of said stator element in mutually spaced juxtaposed relation; means on said stator element for limiting resilient flexing movement of said second portions to planes perpendicular to said surface of said stator element; said rotor element having a surface facing said surface on said stator element, said rotor element having a plurality of contact members projecting outwardly of said facing surface, and overlying said second portions of said contacts on said stator element to selectively bridge adjacent pairs thereof.

2. A switch in accordance with claim 1, further characterized in said first mentioned means including a plurality of septums extending from said surface of said stator element to define channels therebetween, each accommodating a single second portion of a contact on said stator element.

3. A switch in accordance with claim 1, further characterized in said rotor element including insulative projections on said facing surface for maintaining said second portions of said contacts within predetermined arcuate paths of motion to facilitate movement of the contacts on said rotor element thereover.

4. A switch in accordance with claim 1, further characterized in said stator element having an insulative contact retaining ring thereon containing said bores, said stator element including a plurality of corresponding quasi-cylindrical sockets into which said second portions of said wire-like flexible contacts are inserted during assembly.

* * * * *